United States Patent [19]

Prokupek

[11] Patent Number: 5,048,829

[45] Date of Patent: Sep. 17, 1991

[54] AMUSEMENT BALL

[76] Inventor: Alvin Prokupek, P.O. Box 521, Downers Grove, Ill. 60515

[21] Appl. No.: 654,599

[22] Filed: Feb. 13, 1991

[51] Int. Cl.[5] ..... A63B 43/04; A63B 39/06; A63B 37/12

[52] U.S. Cl. ..... 273/58 K; 273/65 EG; 273/58 BA; 273/58 A

[58] Field of Search ..... 273/58 K, 65 EG, 58 A, 273/58 B, 58 BA, 60 R, 60 A, 60 B, 65 ED, 128 A

[56] References Cited

U.S. PATENT DOCUMENTS

| | | | |
|---|---|---|---|
| 1,502,784 | 7/1924 | Kennedy | 273/60 A |
| 2,194,674 | 3/1940 | Riddell | 273/65 EF |
| 2,495,079 | 1/1950 | Sonnett et al. | 273/65 EG |
| 3,439,917 | 4/1969 | Gentile | 273/59 R |
| 4,029,316 | 6/1977 | Clarke | 273/58 K |

*Primary Examiner*—George J. Marlo
*Attorney, Agent, or Firm*—Douglas B. White

[57] ABSTRACT

A new ball shaped amusement device is described wherein a core center of a ball is covered with a partial (figure-8) outer layer, thereby presenting a firm edge around the periphery of the partial layer. Moreover, this partial layer is chosen in the traditional figure-8 pattern generally seen as seams in popular baseballs, to present a striking visual resemblance as well as the desired irregular surface. With this surface contour the flight of the ball as well as its bounce take on new and unusual paths.

2 Claims, 2 Drawing Sheets

FIG. 1a
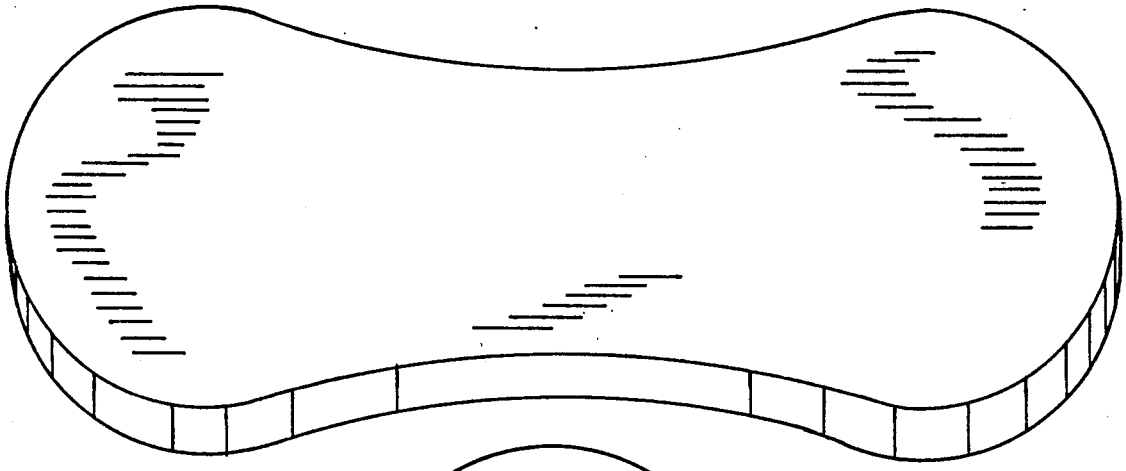
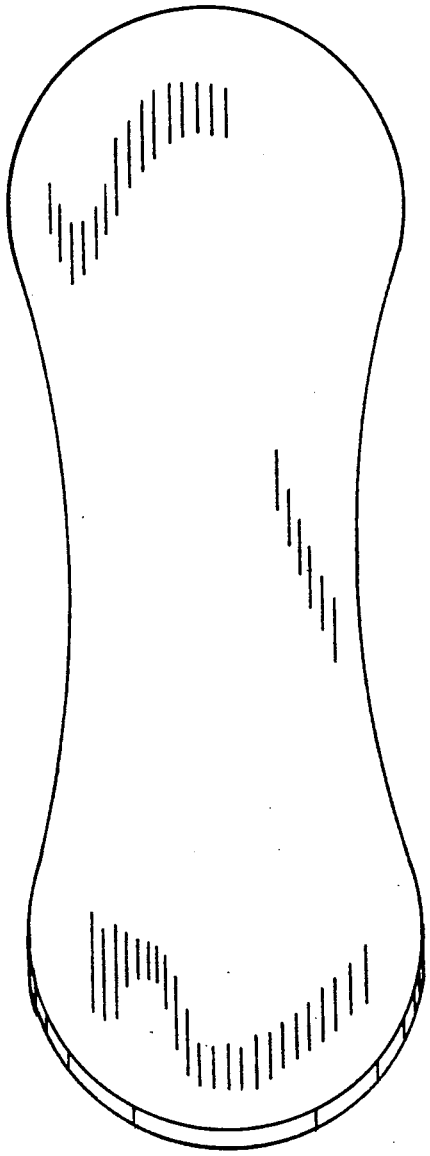
FIG. 1b

AMUSEMENT BALL

BACKGROUND OF THE INVENTION

1. Field of the Invention

The present invention relates to amusement devices, toys, and particularly those of the ball type.

2. Description of the Prior Art

Generally balls of various types have been known, and many versions have been directed toward producing unusual performance characteristics. In U.S. Pat. No. 3,931,971, a ball is presented with six planar surfaces and is claimed to achieve flight paths varying with its spin. In U.S. Pat. No. 4,003,573, an egg-shaped ball is presented which exhibits numerous randomly positioned ridges in order to cause erratic bouncing. In U.S. Pat. No. 2,362,064, two ball shape concepts are described: one having a plurality of flat sides, and another having a plurality of bumps. As a result an unusual bounce is obtained. In U.S. Pat. No. 2,031,240, another ball toy is presented which exhibits a plurality of lobes claimed to cause uncertain bouncing. In U.S. Pat. Nos. 2,086,094 and 2,078,382, circumscribing bands are used on balls and claimed to affect their rebound.

In spite of these many variations, no prior design presents a ball having such surface non-uniformity which maintains the basic baseball look and yields a design which can be economically manufactured.

SUMMARY OF THE INVENTION

A new ball shaped amusement device is described wherein a core center of a ball is covered with a partial (figure-8) outer layer, thereby presenting a firm edge around the periphery of the partial layer. Moreover, this partial layer is chosen in the traditional figure-8 pattern generally seen as seams in popular baseballs, to present a striking visual resemblance as well as the desired irregular surface. With this surface contour the flight of the ball as well as its bounce take on new and unusual paths.

BRIEF DESCRIPTION OF THE DRAWINGS

FIGS. 1*a* and 1*b* depict a plan view of "figure-8" portions of differing thickness used to form the cover of the ball in one embodiment.

Figure 2:
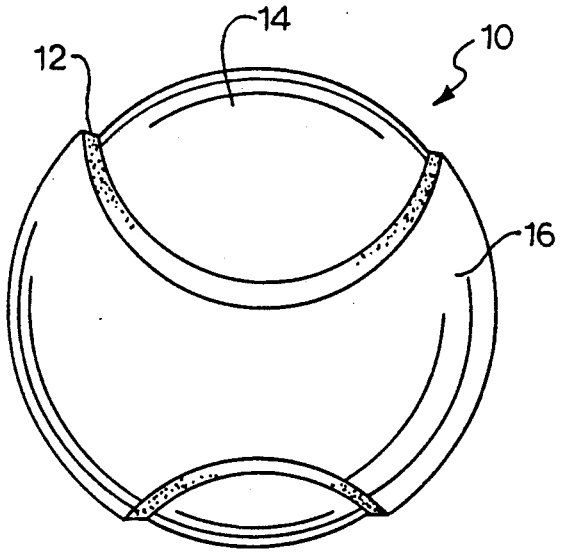
FIG. 2 is a perspective view of the ball in one embodiment of the present invention.
Figure 3:
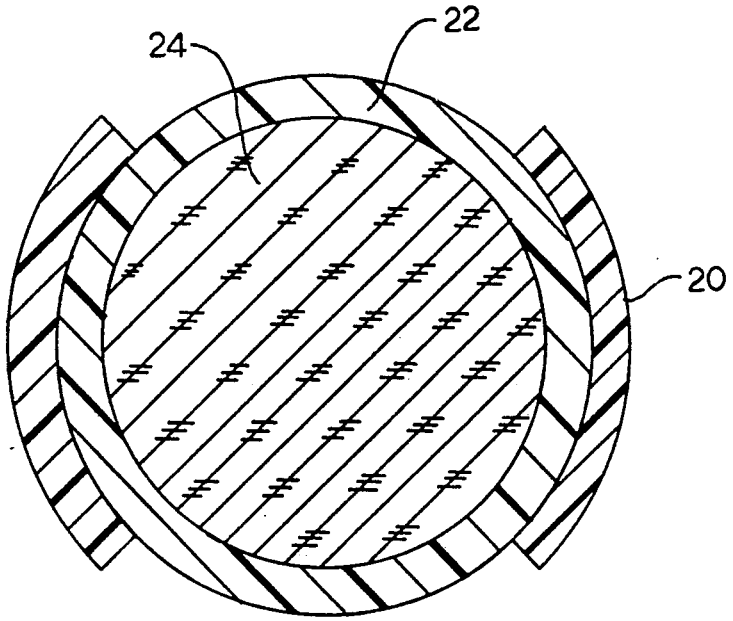
FIG. 3 is a cross sectional view of a second embodiment of the invention.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Turning now to the drawings, there is depicted an amusement ball 10 constructed in accordance with the present invention. This ball is generally described in one embodiment by the attachment of an irregular cover to a core (not shown).

Any core produced by methods well known in the art may be used. But it is preferable to choose a core that reflects the designed use of the ball. For example, if a soft rubbery ball is to be achieved, the core should be soft and rubbery. If a hard baseball version is desired, then a harder core will be required.

The essence of the present invention is in the unique two part cover design. This cover presents the familiar figure-8 seam appearance as an edge 12. This edge is produced as a result of a difference in diameters between the two diametrically opposite portions 14 and 16. Such dual diameters may be obtained by a number of techniques. In one method, two figure-8 sections (as shown in FIG. 1) can be formed with one section thicker then the other; and when affixed to the core an edge will result at the transition between sections. Alternatively, the thinner figure-8 section can be replaced by a complete layer which encompasses the whole ball (or be eliminated altogether). The raised section 20 is formed in the familiar figure-8 pattern and attached over a thin cover layer 22 which in turn envelops the ball core 24. The result is an exposed edge around the periphery of the raised figure 8 cover.

With the edge described above, the ball will produce an unpredictable bounce during play. The direction and degree of bounce will depend on the portion of the ball on which the ball lands. If it hits squarely on the thick part of the cover, the bounce will be more attenuated then when it strikes on the thinner section of cover. When it strikes an edge, the direction and degree of bounce will depend on the angle on which the edge is struck as well as the proportion of thick/thin cover involved.

From the foregoing description, it will be apparent that modifications can be made to the apparatus and method for using same without departing from the teachings of the present invention. Accordingly, the scope of the invention is only to be limited as necessitated by the accompanying claims.

I claim:

1. An amusement ball comprising:

a core; and a flexible cover attached to said core, said cover being formed of two intermeshing figure-8 sections, wherein one section is thicker than the other section, whereby an edge is formed at the transition between said sections to significantly affect the direction and degree of rebounds of said ball when bounced.

2. An amusement ball comprising:

a core;

a first flexible cover layer encompassing said core; and a second flexible cover having a predetermined thickness formed in a substantially figure-8 pattern and affixed over said first cover, whereby an edge is formed along the periphery of said second cover to significantly affect the direction and degree of rebounds of said ball when bounced.

* * * * *